US011002272B2

(12) United States Patent
Klotten et al.

(10) Patent No.: US 11,002,272 B2
(45) Date of Patent: May 11, 2021

(54) GASEOUS FLUID COMPRESSION DEVICE

(71) Applicant: Hanon Systems, Daejeon (KR)

(72) Inventors: Thomas Klotten, Cologne (DE); Dennis Kroecker, Cologne (DE)

(73) Assignee: HANON SYSTEMS, Daejeon (KR)

( * ) Notice: Subject to any disclaimer, the term of this patent is extended or adjusted under 35 U.S.C. 154(b) by 40 days.

(21) Appl. No.: 16/301,619

(22) PCT Filed: Aug. 17, 2017

(86) PCT No.: PCT/KR2017/008956

§ 371 (c)(1),
(2) Date: Nov. 14, 2018

(87) PCT Pub. No.: WO2018/062684

PCT Pub. Date: Apr. 5, 2018

(65) Prior Publication Data

US 2019/0285066 A1 Sep. 19, 2019

(30) Foreign Application Priority Data

Sep. 29, 2016 (DE) ..... 102016118525.6

(51) Int. Cl.
*F04C 2/02* (2006.01)
*F04C 27/00* (2006.01)
(Continued)

(52) U.S. Cl.
CPC ..... *F04C 2/025* (2013.01); *F01C 17/063* (2013.01); *F04C 13/001* (2013.01); *F04C 18/02* (2013.01);
(Continued)

(58) Field of Classification Search
CPC ..... F04C 2/025; F04C 13/001; F04C 18/02; F04C 27/003; F04C 27/005; F04C 27/008;
(Continued)

(56) References Cited

U.S. PATENT DOCUMENTS 4,702,683 A * 10/1987 Inaba ..... F04C 18/0215 418/55.6
2015/0152731 A1* 6/2015 Yamashita ..... F01C 21/02 418/55.5
(Continued)

FOREIGN PATENT DOCUMENTS

DE 60300376 T2 2/2006
EP 1464840 A1 10/2004
(Continued)

OTHER PUBLICATIONS

"Groover, Mikell P., Fundamentals of Modern Manufacturing: Materials, Processes, and Systems, 2007, John Wiley and Sons, 3rd Edition, p. 772" (Year: 2007).*

*Primary Examiner* — Connor J Tremarche
(74) *Attorney, Agent, or Firm* — Shumaker, Loop & Kendrick, LLP; James D. Miller

(57) ABSTRACT

An apparatus for compressing gas-phase fluid including a housing having a wall, a stator having a base plate and a helical wall extending from one side of the base plate, and an orbiter having a base plate and a helical wall extending therefrom. The base plates are disposed such that the wall of the stator and the wall of the orbiter engage with each other to define closed working chambers. The volumes and positions of the working chambers are changed in response to the motion of the orbiter. The apparatus includes a guide device having an opening formed in the base plate of the orbiter and a pin coupled to the housing. The pin engages the opening. A sliding element is disposed between the wall of the housing and the orbiter and coupled to the wall. The pin is pressed into an opening formed in the sliding element.

10 Claims, 5 Drawing Sheets

(51) Int. Cl.

| | |
|---|---|
| ***F04C 13/00*** | (2006.01) |
| ***F04C 29/00*** | (2006.01) |
| ***F04C 28/22*** | (2006.01) |
| ***F01C 17/06*** | (2006.01) |
| ***F04C 18/02*** | (2006.01) |

(52) U.S. Cl.
CPC ..... *F04C 18/0215* (2013.01); *F04C 27/003* (2013.01); *F04C 27/005* (2013.01); *F04C 27/008* (2013.01); *F04C 28/22* (2013.01); *F04C 29/00* (2013.01); *F04C 2230/60* (2013.01); *F05C 2201/0448* (2013.01)

(58) Field of Classification Search
CPC ..... F04C 28/22; F04C 29/00; F04C 2230/60; F05C 2201/0448; F01C 17/063
See application file for complete search history.

(56) References Cited

U.S. PATENT DOCUMENTS

2016/0090986 A1* 3/2016 Imai ..... F04C 18/0215 418/55.3
2016/0160646 A1* 6/2016 Taguchi ..... F04C 18/0215 418/55.3
2016/0369799 A1* 12/2016 Duppert ..... F04C 18/0215

FOREIGN PATENT DOCUMENTS

| | | | |
|---|---|---|---|
| EP | 1867876 | A2 | 12/2007 |
| EP | 2012016 | A1 | 1/2009 |
| EP | 2218914 | A2 | 8/2010 |
| EP | 2618000 | A1 | 7/2013 |
| JP | H02277988 | A | 11/1990 |
| JP | H0668276 | B2 | 8/1994 |
| JP | H08338376 | A | 12/1996 |
| JP | H09151864 | A | 6/1997 |
| JP | 2001132670 | A | 5/2001 |
| JP | 2004124735 | A | 4/2004 |
| JP | 2009281280 | A | 12/2009 |
| JP | 2012167605 | A | 9/2012 |
| JP | 2012229650 | A | 11/2012 |
| JP | 2015034506 | A | 2/2015 |
| JP | 2015086765 | A | 5/2015 |
| JP | 2016156297 | A | 9/2016 |
| KR | 100446213 | B1 | 8/2004 |
| KR | 20140095827 | A | 8/2014 |
| WO | 2015016028 | A1 | 2/2015 |
| WO | 2015060038 | A1 | 4/2015 |
| WO | 2015198516 | A1 | 12/2015 |

* cited by examiner

GASEOUS FLUID COMPRESSION DEVICE

CROSS-REFERENCE TO RELATED PATENT APPLICATIONS

This application is a United States nation phase patent application based on PCT/KR2017/008956 filed on Aug. 17, 2017, which claims the benefit of German Patent Application No. 10 2016 118525.6 filed on Sep. 29, 2016, the entire disclosures of which are hereby incorporated herein by reference.

TECHNICAL FIELD

The present disclosure relates to an apparatus for compressing a gas-phase fluid, particularly a refrigerant. The apparatus includes a housing having a wall, a non-motional stator having a base plate and a helical wall extending from a first side of the base plate, and a motional orbiter having a base plate and a helical wall extending from the base plate. The base plates are disposed such that the wall of the stator and the wall of the orbiter engage with each other to define closed working chambers. The volumes and positions of the working chambers are changed in response to the motion of the orbiter.

BACKGROUND ART

Compressors referred to as refrigerant compressors are used for movable applications to provide refrigerant through a refrigerant passage, particularly for air-conditioning systems for vehicles, which are well known in the art. These compressors are sometimes configured as piston compressors or scroll compressors that each have a variable stroke volume irrespectively of refrigerant. The compressors are driven by pulleys or in an electrical manner.

FIGS. 1 and 2 illustrate a scroll compressor 1', which is well known in the art, in section. The conventional scroll compressor 1' includes a housing 2, a non-motional fixed stator 3, which has a disk-type base plate 3*a* and a helical wall 3*b* extending from the base plate 3*a*, and a motional orbiter 4 which has a disk-type base plate 4*a* and a helical wall 4*b* extending from the base plate 4*a*. In brief, the stator 3 referred to as a non-motional or fixed spiral 3 cooperates with the orbiter 4 referred to as a motional spiral 4. The base plates 3 and 4 are disposed such that the wall 3*b* of the stator 3 engages with the wall 4*b* of the orbiter 4. The motional spiral 4 is moved in circular orbit by an eccentric actuator. The walls 3*b* and 4*b* come into contact with each other on multiple points during the motion of the spiral 4 to define a number of continuous closed working chambers 5 within the walls 3*b* and 4*b*, and adjacent working chambers 5 of them limit different large volumes. The volumes and positions of the working chambers 5 are changed in response to the motion of the orbiter 4. The volumes of the working chambers 5 are gradually reduced to the centers of the helical walls 3*b* and 4*b* referred to as spiral walls. The eccentric actuator consists of a drive shaft 6 rotating about an axis of rotation 7 and an intermediate element 8. The drive shaft 6 is supported on the housing 2 by a first bearing 9. The orbiter 4 is eccentrically connected with the drive shaft 6 by the intermediate element 8, namely the axes of the orbiter 4 and the drive shaft 6 are offset from each other. The orbiter 4 is supported on the intermediate element 8 by a second bearing 10.

The conventional scroll compressor 1' also includes a guide device 11 that prevents the rotation of the motional spiral 4 and achieves the orbiting of the motional spiral 4. The guide device 11 generally includes a number of circular openings 11*a* arranged adjacently at a specific distance. Preferably, the openings 11*a* formed as blind holes are formed in the base plate 4*a* of the motional spiral 4. In addition, the guide device 11 includes pins 11*b* that are protrudingly formed on the wall 12 of the housing 2 and respectively engage into the openings 11*a* formed in the base plate 4*a* of the motional spiral 4. The first ends of the pins 11*b* protrude from the wall 12 and the second ends thereof are disposed within the wall 12 of the housing 2.

WO 2015 060038 A1 discloses a scroll compressor including a guide device to prevent the rotation of a motional spiral and achieve the orbiting thereof. The guide device includes openings formed in a base plate of the motional spiral and pins engage into the openings. The pins are pressed into a housing, particularly bores formed in the housing.

JP 2009-281280 discloses a scroll compressor with the cooling of a mechanism for adjusting the rotational position of a motional spiral. A component formed as a center plate of a housing includes through-bores for positioning guide pins for the motional spiral. Each of the guide pins is pressed into an associated one of the through-bores. The guide pins are cooled on the one hand by a refrigerant flowing between the center plate and the motional spiral and on the other hand by a refrigerant introduced into the through-bores from the side of center plate away from the motional spiral.

As illustrated in FIGS. 1 and 2, the known scroll compressor 1' includes the wall 12 referred to as a facing wall 12 which is disposed in and fixed on the housing 2. A counter-pressure area 13 is defined between the facing wall 12 and the motional spiral 4. By the counter pressure occurring in the counter-pressure area 13, the motional spiral 4 applies force to the fixed spiral 3 fixed on the housing 2 such as the facing wall 12. To seal the counter-pressure area 13 and a suction area 14, a ring-shaped sealing element 15 is disposed between the motional spiral 4 and the facing wall 12. The motional spiral 4 has a surface 16 aligned toward the facing wall 2 on one end thereof. The sealing concept of the scroll compressor 1' includes a sliding element 17' formed as a plate together with the sealing element 15, and the sliding element is fixedly coupled to the housing, particularly the facing wall 12 without movement.

The plate-type fixed sliding element 17' disposed between the facing wall 12 and the spiral 4 is provided as a support surface of the surface of the motional spiral 4 together with the sealing element 15, and for compensation of friction generated by the relative motion between the facing wall 12 and the spiral 4. The sliding element 17' seals the suction area 14 and the counter-pressure area 13 from each other by a combination with the sealing element 15, the suction area 14 and the counter-pressure area 13 being pressure chambers to which two different pressures are applied. In addition, the sliding element 17' has to abut on the facing wall 12 of the housing 2 in a sealed manner. The sealed coupling is ensured by adhesion and lubricants, particularly refrigerant oil mixtures. The sliding element 17' is made of a material having very good tribological characteristics and has corrosion resistance and heat resistance. The scroll compressors 1' known in the art include the sliding element 17' disposed on the housing 2 with a very small wall thickness. The pins 11*b*, which are provided as guide elements and disposed within the facing wall 12, and the openings 11*a*, which are formed as pockets in the base plate 4*a* of the motional spiral 4, are circulated and thus provided to guide the spiral 4 in motion. In connection with the material of the housing 2, particularly the sealing and corrosion resistance thereof, the pins 11*b* must be made of aluminum. However, aluminum is not suitable in relation to tribological characteristics and strength.

In refrigerant passages through which carbon dioxide as a refrigerant with cooling technical sign R744 flows, the pressure level of suction pressure and discharge pressure occurring in the scroll compressor 1' is substantially higher than in the conventional refrigerant passages, namely a pressure difference in refrigerant within the working chambers 5 is substantially higher than, for example, in the scroll compressor 1' used in refrigerant passages through which R134a as a refrigerant flows. A higher pressure difference makes the force, which acts on the pins 11*b* from the orbiter 14, substantially larger. The pins 11*b* conventionally made of steel are position pins or guide pins and are separately pressed into the housing 2 made of aluminum, which have a significantly different expansion efficiency from the aluminum of the housing 2. Due to the substantially higher acting force, the significantly different expansion efficiencies between steel and aluminum, and the small strength of aluminum, the scroll compressor 1' known in the art has a high risk of misaligning the pins 11*b* within the wall 12 of the housing 2.

Other challenges are given in connection with an installation space to be optimized, particularly in the arrangement and formation of the bearings 9 and 10 relating to the changed requirements for accommodation of substantially larger force into the area of the second bearing 10. The installation space is limited due to the relatively small strength of aluminum and the reason is because the fixed minimum material thickness or wall thickness of the housing 2 is required between recesses for insertion of the pins 11*b* and the bearing 10. In addition, the motional spiral 4 is designed to be heavier by demands for higher action force thereon, and the immediate element 8 having a larger counterweight provided as the weight for compensating the imbalance of orbiter 4 is also formed. The immediate element 8, particularly the counterweight is disposed in the recess into which the bearing 10 is inserted. The installation space for the immediate element 8 is very limited.

SUMMARY

An object of the present disclosure is therefore to provide an apparatus for compressing gas-phase fluid, particularly to improve a scroll compressor having a counter-pressure area and a suction area to which a fluid is applied at different pressure levels. The counter-pressure area can be sealed to the suction area in a sealed manner, and it is possible to compensate friction of an orbiter on a housing. Since position pins or guide pins of a guide device to prevent the rotation of the motional spiral and achieve the orbiting thereof are securely and continuously disposed, the maximum service life of the apparatus is ensured. The apparatus can be configured for the high pressure level of fluid. The apparatus must be easily implemented in its structure to minimize costs at the time of manufacture and maintenance.

This object is achieved by a subject having the features shown and described herein.

The object is achieved by an apparatus for compressing a gas-phase fluid, particularly a refrigerant according to the present disclosure. The apparatus includes a housing having a wall, a non-motional stator having a base plate and a helical wall extending from one side of the base plate, and a motional orbiter having a base plate and a helical wall extending from the base plate. The base plates are disposed such that the wall of the stator and the wall of the orbiter engage with each other to define closed working chambers. The volumes and positions of the working chambers are changed in response to the motion of the orbiter. The apparatus also includes a guide device having at least one opening formed in the base plate of the orbiter and at least one pin fixedly coupled to and protruding from the housing. The pin engages into the opening formed in the base plate of the orbiter.

According to the concept of the present disclosure, the apparatus includes a sliding element disposed between the wall of the housing and the orbiter and fixedly coupled to the wall. According to the present disclosure, the at least one pin is pressed into an opening formed in the sliding element.

The sliding element may have a circular ring disk shape that has an inner diameter, an outer diameter, a thickness, an outer jacket surface, and two circular ring surfaces.

According to an embodiment of the present disclosure, the sliding element and the at least one pin may be made of materials in which values of strength and thermal expansion efficiency as material characteristics are in the same range. The meaning that there is in the same range is that the material characteristics such as strength and thermal expansion have only a negligible small deviation under the operating conditions such as specific pressure and temperature. The sliding element may be made of steel.

In the embodiment of the present disclosure, the at least one pin may also be made of steel.

According to a first alternative embodiment of the present disclosure, the sliding element may be pressed into and coupled to the housing by force-fit. According to a second alternative embodiment of the present disclosure, the sliding element may be incorporated into and coupled to the housing by transition-fit. The housing may include a recess having a side and a base surface. One circular ring surface of the sliding element may abut on the base surface of the recess. The side of the recess may be fitted and coupled to an outer jacket surface of the sliding element.

According to another embodiment of the present disclosure, the sliding element may include a ring-shaped groove for accommodation of a sealing element formed as an O-ring. The ring-shaped groove may be formed on an outer jacket surface of the sliding element. The sliding element and the sealing element may be provide to seal the suction area and counter-pressure area, separated from each other by the wall of the housing, particularly of the apparatus configured as a scroll compressor.

According to the embodiment of the present disclosure, the at least one opening formed in the sliding element for accommodation of the pin may be formed as a through-bore.

The at least one pin of the guide device may be disposed in the through-bore such that an end of the pin formed away from an end of the guide device engaging into the opening engages into an opening formed in the wall of the housing, on which the sliding element abuts, through the sliding element.

According to an alternative embodiment of the present disclosure, the apparatus may include pin elements formed to dispose within openings formed in the sliding element and to protrude into openings formed in the wall of the housing.

The pins of the guide device disposed in the through-bores and engaging into the openings formed in the wall of the housing through the sliding element and the pin elements protruding into the opening formed in the wall of the housing may prevent the rotation of the sliding element relative to the wall of the housing.

In summary, the apparatus according to the present disclosure has the following various features:

- the pins of the guide device can be optimally aligned, for example even for higher requirements for pressure and force acting during the use of carbon dioxide as a fluid to be compressed since the tilting of the pins is prevented;
- the wall thickness between the inner diameter of the housing in the counter-pressure area and the openings for accommodation of the pins of the guide device within the facing wall can be minimized;
- by providing a larger installation space within the counter-pressure area compared to the conventional scroll compressors, it is possible to dispose a larger bearing and a larger intermediate element, particularly a larger counterweight to support the orbiter on the intermediate element and thus the drive shaft; and
- it is possible to ensure the maximum service life of the apparatus configured for the high pressure levels of fluid.

Other individual matters, features, and advantages of the embodiments of the present disclosure are proposed in the following description of the embodiments with reference to the related drawings. The drawings illustrate the compression mechanism of the scroll compressor including the stator and orbiter defining the working chambers by the helical walls engaging with each other, the counter-pressure area defined between the orbiter and the housing, and the guide device to prevent the rotation of the motional spiral and achieve the orbiting thereof in section, respectively.

An apparatus for compressing gas-phase fluid according to the present disclosure has the following effects:

- pins of a guide device can be optimally aligned, for example even for higher requirements for pressure and force acting during the use of carbon dioxide as a fluid to be compressed since the tilting of the pins is prevented;
- the wall thickness between the inner diameter of a housing in a counter-pressure area and openings for accommodation of the pins of the guide device within a facing wall can be minimized;
- by providing a larger installation space within the counter-pressure area compared to the conventional scroll compressors, it is possible to dispose a larger bearing and a larger intermediate element, particularly a larger counterweight to support an orbiter on an intermediate element and thus a drive shaft; and
- it is possible to ensure the maximum service life of the apparatus configured for the high pressure levels of fluid.

BEST MODE FOR INVENTION

Figure 1:
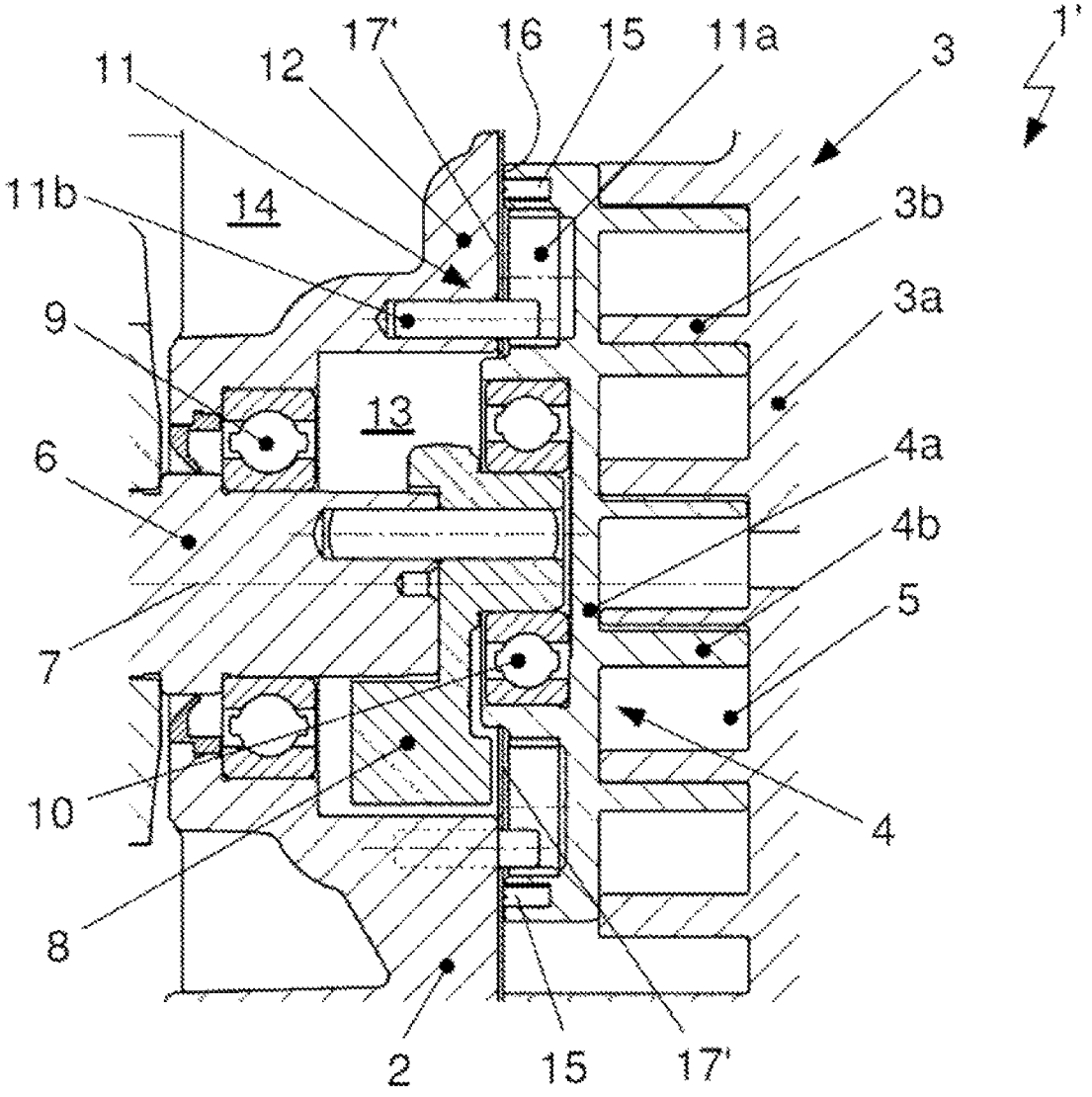
FIG. 1 PRIOR ART
FIGS. 1 and 2 are cross-sectional views of a conventional scroll compressor, respectively.
Figure 2:
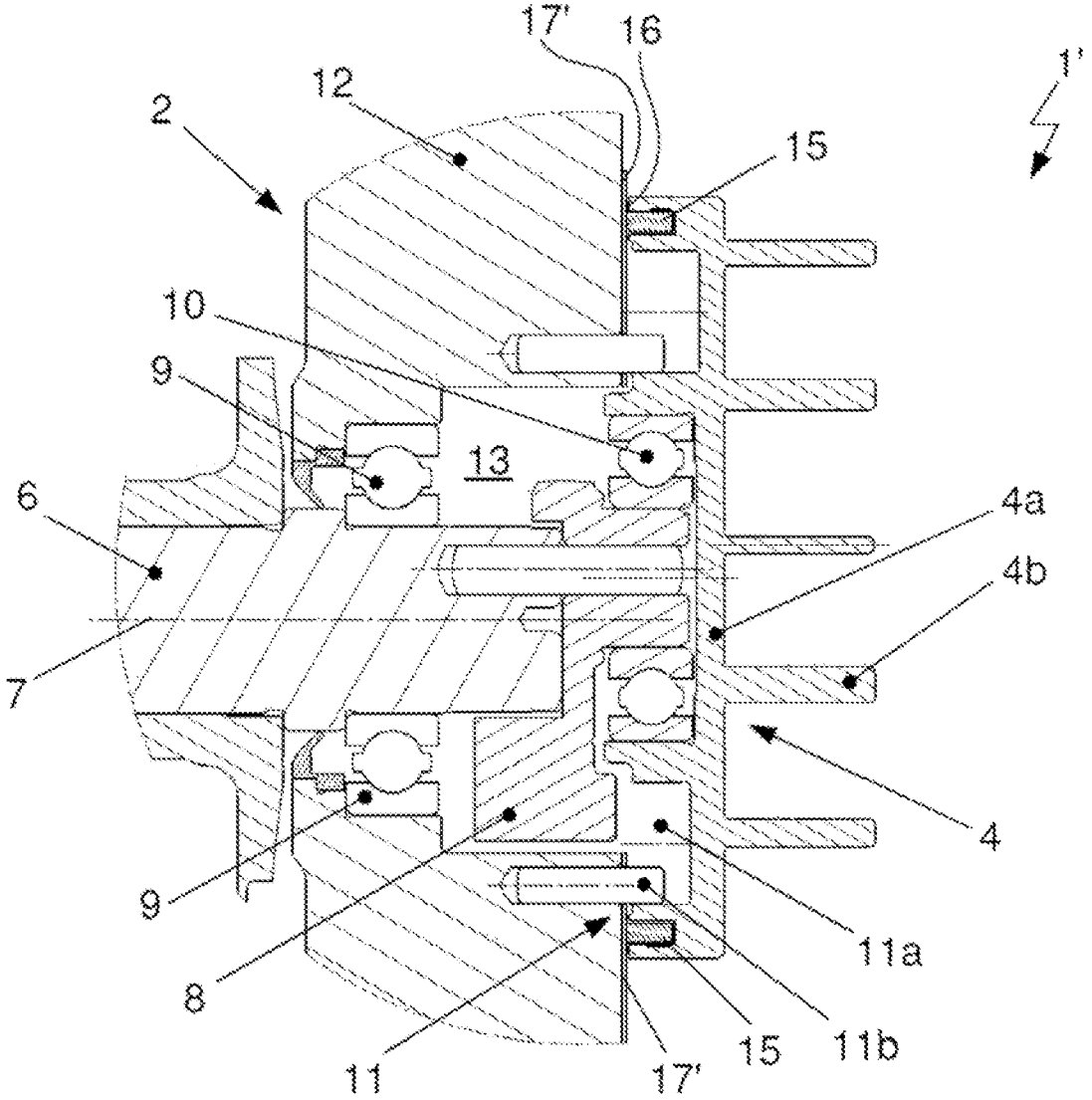
FIG. 2 PRIOR ART
Figure 3:
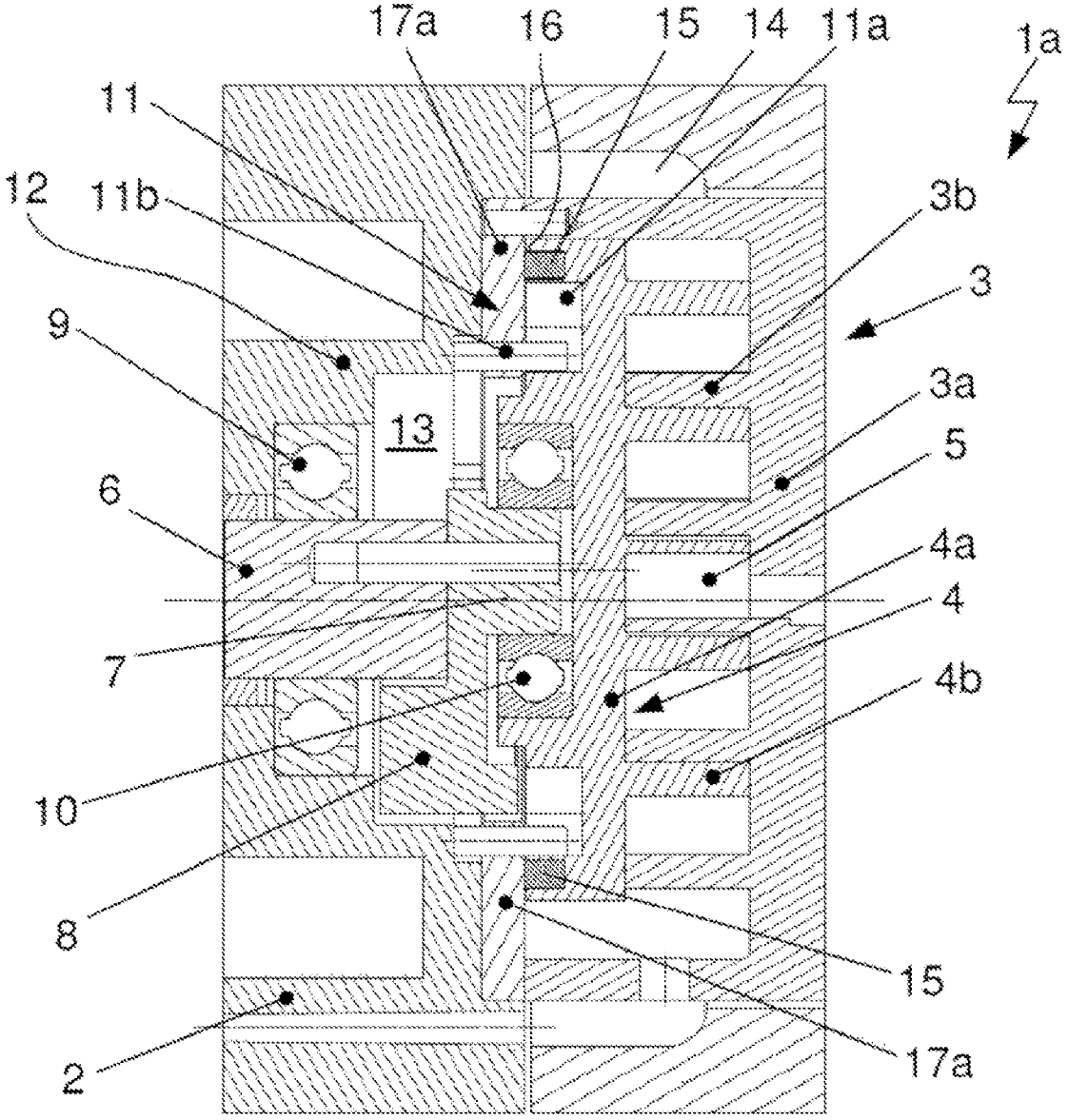
FIG. 3 is a cross-sectional view a scroll compressor having a plate-type sliding element for accommodation of pins of a guide device, which are pressed into and coupled to a housing by force-fit coupling.

FIG. 3 illustrates an apparatus for compressing gas-phase fluid 1*a*, particularly a scroll compressor having a compression mechanism disposed in a housing 2, which consists of a stator 3 and an orbiter 4, in section. Helical walls 3*b* and 4*b*, which are respectively disposed on base plates 3*a* and 4*a* and engage with each other, define working chambers 5.

Since the orbiter 4 is moved in circular orbit by an eccentric actuator, the helical wall 4*b* orbits about the stationary helical wall 3*b*. During the relative motion of the helical walls 3*b* and 4*b*, the walls 3*b* and 4*b* come into contact with each other many times and define a number of working chambers 5 becoming smaller. The working chambers 5 become smaller and compress a fluid by the relative motion of two intertwined helical walls 3*b* and 4*b*. A gas-phase fluid to be compressed, particularly a refrigerant is sucked to be compressed in the apparatus 1*a* and discharged through an outlet which is not illustrated.

A drive shaft 6 driving the orbiter 4 is supported and maintained on the housing 2 by a first bearing 9, particularly a ball bearing. The drive shaft 6 and the first bearing 9 rotate about an axis of rotation 7 of the drive shaft 6. The first bearing 9 is disposed around the drive shaft 6 and the areas of the outer surface and side thereof abut on a wall 12 of the housing 2. The drive shaft 6 is mechanically connected to the orbiter 4 with eccentricity by an intermediate element 8 and a second bearing 10. The wall 12 limits a counter-pressure area 13 defined between the orbiter 4 and the housing 2 and forms a separation wall between the counter-pressure area 13 and a suction area 14. The counter-pressure area 13 is defined on the rear of the base plate 4*a* of the motional spiral 4 with respect to the helical wall 4*b* and provided to apply the pressure of the motional spiral 4 to the fixed spiral 3. An intermediate pressure between suction pressure and discharge pressure of a gas-phase fluid is substantially applied to the counter-pressure area 13 referred to as a counter-pressure chamber.

To seal the counter-pressure area 13 and the suction area 14 from each other, a ring-shaped sealing element 15 is disposed between the facing wall 12 and the surface 16 of the motional spiral 4 aligned toward the facing wall 12. The sealing concept with the sealing element 15 includes a sliding element 17*a* formed as a plate, and the sliding element is disposed between the facing wall 12 and the spiral 4. The plate-type fixed sliding element 17*a* provides a contact surface to the surface of the motional spiral 4 together with the sealing element 15 and is provided for compensation of friction occurring during the relative motion between the facing wall 12 and the spiral 4. The suction area 14 and the counter-pressure area 13 are sealed from each other by the sliding element 17*a* and the sealing element 15. In addition, the sliding element 17*a* abuts on the facing wall 12 of the housing 2 in a sealed manner, and the sealed coupling is ensured by adhesion and lubricants, particularly refrigerant oil mixtures. To reduce frictional heat occurring during the motion of the helical walls 3*b* and 4*b* and during the motion of the helical wall 4*b* of the orbiter 4 relative to the facing wall 12, and to improve sealing between the limited surfaces of the waking chambers 5 and between the counter-pressure area 13 and the suction area 14, a lubricant is provided for a fluid.

The apparatus 1*a* includes a guide device 11 to prevent the rotation of the motional spiral 4 and achieve the orbiting thereof. The guide device 11 includes a number of circular openings 11*a* and pins 11*b* formed in a direction of the counter-pressure area 13 in the base plate 4*a* of the orbiter 4. The first ends of the pins 11*b* protrude into the openings 11*a* and the second ends thereof are coupled to the housing 2. The pins 11*b* formed as position elements and guide elements and the openings 11*a* formed as recesses in the base plate 4*a* of the motional spiral 4 are provided to guide the motional spiral 4.

The sliding element 17*a* made of a corrosion-resistant and heat-resistant material having very good tribological characteristics such as steel is coupled to the housing 2, particularly the facing wall 12 without being fixed and moved thereto.

The pins 11*b* made of steel as well are arranged in the openings, particularly through-bores formed in the sliding element 17*a*, respectively. The pins 11*b* are pressed into the openings by the sliding element 17*a*. Since each of the pins 11*b* and the sliding element 17*a* which are made of steel have a very high strength and a similar thermal expansion efficiency, different thermal expansions between the pins 11*b* and the sliding element 17*a* are prevented. This prevents the wall 12 of the housing 2 and thus the pins 11*b* to the openings 11*a* of the motional spiral 4 from tilting during the operation of the apparatus 1*a*. The pins 11*b* are continuously disposed in position and in parallel to each other, thereby ensuring an optimal guide condition for the motional spiral 4.

The sliding element 17*a* is coupled to the housing 2 by external force-fit. The sliding element 17*a* formed as a plate-type or circular ring disk is pressed into the housing 2 in the area of an outer jacket, which ensures the optimal guide of the sliding element 17*a* in the housing. The housing 2 includes a recess having a side and a base surface in the area of the facing wall 12. In an assembled state, one circular ring surface of the sliding element 17*a* abuts on the base surface of the recess of the housing 2, and the side of the recess is coupled to the outer jacket surface of the sliding element 17*a* by force-fit. In addition to or instead of the external force-fit, the sliding element 17*a* is supported in the housing 2 by at least one pin element which is not illustrated, and the pin element prevents the sliding element 17*a* from rotating relative to the housing 2. Preferably, one or two pin elements referred to as rotation prevention pins are used.

In particular, as illustrated in FIG. 3, the pins 11*b* of the guide device 11 are arranged to achieve the function of the rotation prevention pins. The pins 11*b* are arranged to protrude into the facing wall 12 through the sliding element 17*a* abutting on the facing wall 12. The openings provided to accommodate the pins 11*b* in the sliding element 17*a* are formed as through-openings. To accommodate the pins 11*b*, preferably openings or recesses are formed in the facing wall 12. In the case where the pins 11*b* are disposed to pass through the openings formed in the wall 12 through the sliding element 17*a*, the sliding element 17*a* is fixed on the housing 2.

By forming the sliding element 17*a* as a circular ring disk made of steel with a large inner diameter, the inner diameter of the circular ring disk becomes large by the high strength of material. Thus, the inner diameter of the substantially hollow cylindrical-type area of the housing 2, which is limited by the facing wall 12 and provided to accommodate the bearings 9 and 10 of the intermediate element 8, also becomes large. Therefore, the counter-pressure area 13 has a large inner diameter. The large inner diameter of the housing 2 and the large inner diameter of the sliding element 17*a* in the area of the counter-pressure chamber 13 create a large installation space for the bearings 9 and 10, particularly the second bearing 10 to support the orbiter on the intermediate element 8. The wall thickness between the pin bore in the sliding element 17*a* and in some cases the facing wall 12 and the bore for the bearing 10 is minimized by the very high strength of steel which is a material of the sliding element 17*a* and the pins 11*b*. The installation space for the bearing 10 is increased. The expansion of the installation space in the counter-pressure area 13 allows the volume of the intermediate element 8 to be large and thus ensures the use of a heavier counterweight.

Figure 4:
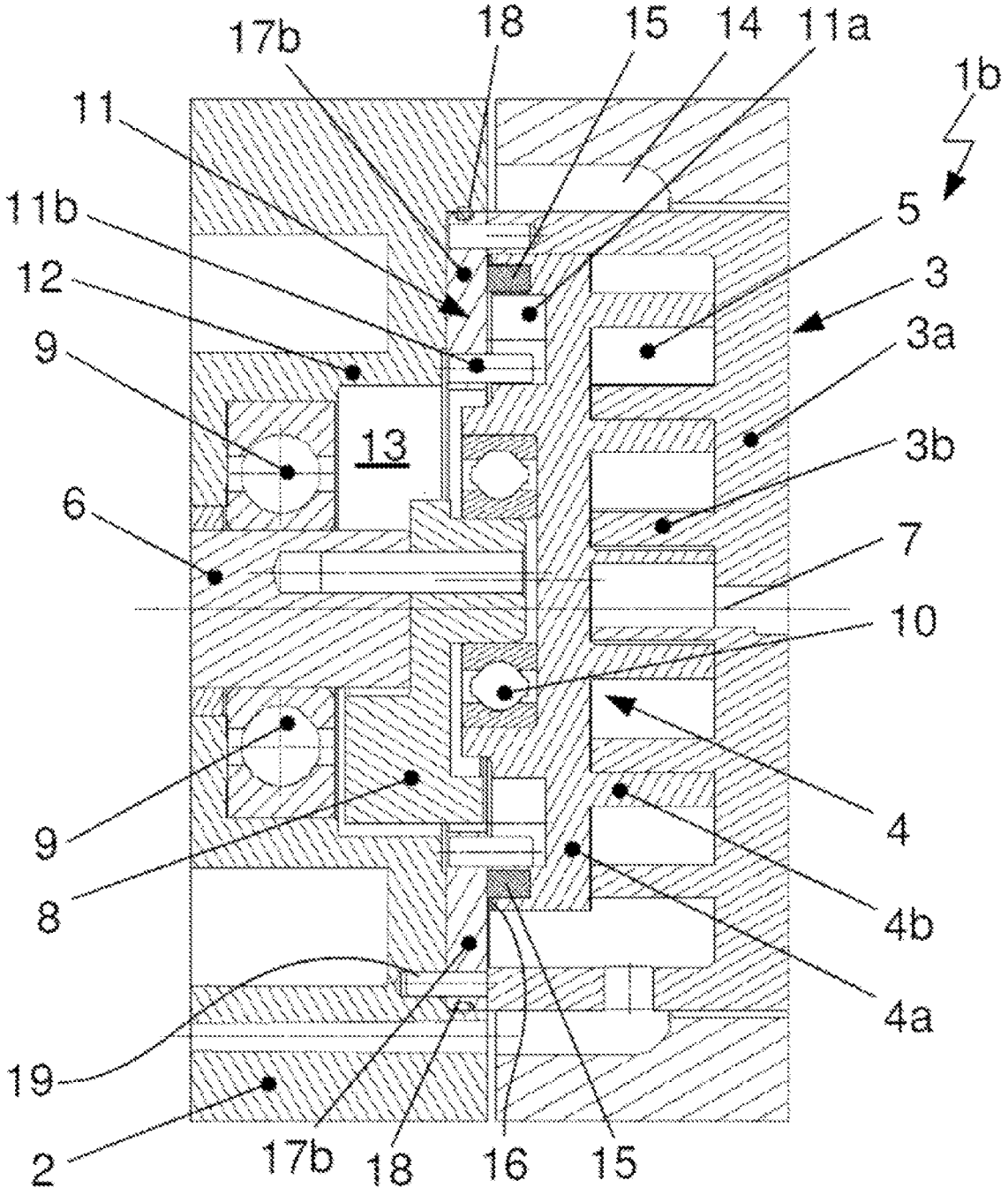
FIG. 4 is a cross-sectional view a scroll compressor having a plate-type sliding element for accommodation of pins of a guide device, which are pressed into a housing by force-fit coupling or coupled to the housing by transition-fit coupling.

FIG. 4 illustrates an apparatus for compressing gas-phase fluid 1*b*, particularly a scroll compressor having a plate-type sliding element 17*b* to accommodate the pins 11*b* of the guide device 11. The difference from the apparatus 1*a* illustrated in FIG. 3 is in that the sliding element 17*b* includes a groove 18, particularly a ring-shaped groove 18 for accommodation of an O-ring. The groove 18 and the O-ring as a sealing element disposed in the groove extend on the outer jacket surface of the circular ring disk and seal the sliding element 17*b* to the facing wall 12 and thus the housing 2.

Alternatively, the sliding element 17*b* is coupled to the housing 2 by external force-fit or transition-fit. The sliding element 17*b* formed as a circular ring disk is pressed into and put in the housing 2 in the area of the outer jacket. In addition to the individual fit coupling, the sliding element 17*b* may be disposed to be supported in the housing 2 by at least one pin element 19 that prevents the rotation of the sliding element 17*b* relative to the housing 2. Preferably, one or two pin elements 19 referred to as rotation prevention pins are used. The pin elements 19 are disposed within the openings formed in the sliding element 17*b* and protrude into the openings formed in the housing wall 12.

In the apparatus 1*b* including the ring-shaped groove 18 and the sliding element 17*b* having the O-ring, several and repetitive assembly and disassembly are possible, unlike the apparatus 1*a*, illustrated in FIG. 3, including the sliding element 17*a* disposed by force-fit coupling. The sealing of the counter-pressure area to the suction area 14 is always recoverable.

In addition, the apparatus 1*b* may be provided with an intermediate element 8 that has a larger volume and thus has a heavier counterweight. It is possible to more flexibly use the provided installation space because the intermediate element 8, particularly the counterweight may have an undercut shape.

Figure 5:
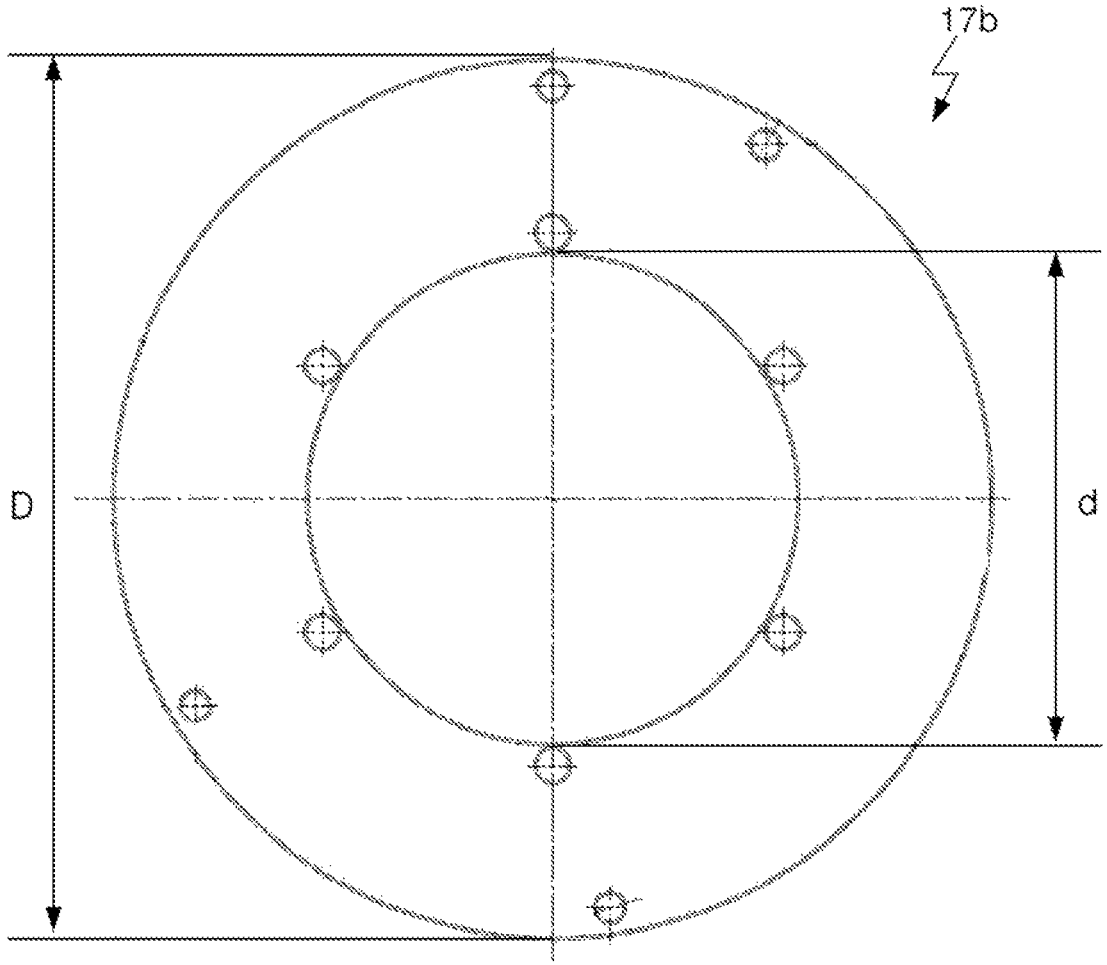
FIGS. 5 and 6 are individual views of the sliding element of FIG. 4.
Figure 6:
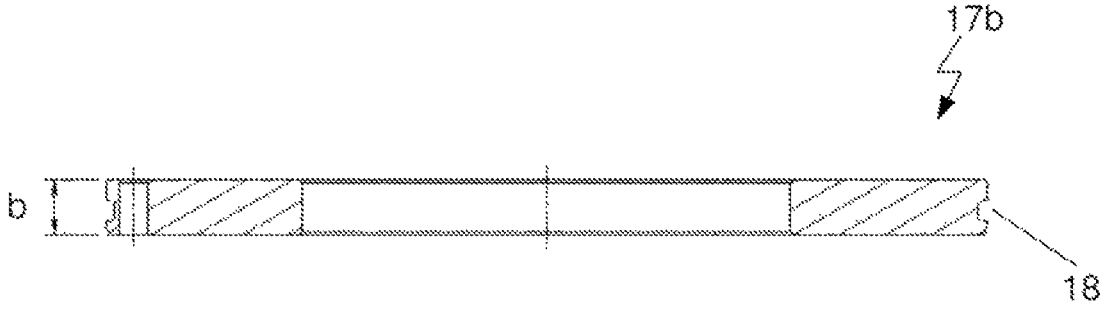

FIGS. 5 and 6 are individual views illustrating the sliding element 17*b* of the apparatus 1*b* illustrated in FIG. 4. The circular ring disk type sliding element 17*b* has an inner diameter d, an outer diameter D, and a thickness b. The thickness b ranges from 4 mm to 8 mm, particularly is made of about 6 mm. The inner diameter ranges from 50 mm to 55 mm, particularly is made of about 53 mm. The outer diameter ranges from 90 mm to 100 mm, particularly is made of about 96 mm.

The pins 11*b* are guided or inserted into the sliding element 17*b* within the openings formed in the area of the inner diameter d, and the openings are uniformly distributed and arranged at the same distance. In contrast, the pin elements 19 are rotation prevention pins, which are inserted into the sliding element 17*b* within the openings formed in the area of the outer diameter D.

The present disclosure relates to an apparatus for compressing a gas-phase fluid, particularly a refrigerant. The apparatus includes a housing having a wall, a non-motional stator having a base plate and a helical wall extending from a first side of the base plate, and a motional orbiter having a base plate and a helical wall extending from the base plate. The base plates are disposed such that the wall of the stator and the wall of the orbiter engage with each other to define closed working chambers. The volumes and positions of the working chambers are changed in response to the motion of the orbiter.

The invention claimed is:

1. An apparatus for compressing gas-phase fluid comprising: a housing having a wall; a non-motional stator having a base plate and a helical wall extending from one side of the base plate; a motional orbiter having a base plate and a helical wall extending from the base plate, the base plate of the stator and the base plate of the motional orbiter disposed wherein the wall of the stator and the wall of the motional orbiter engage each other to define closed working chambers, volumes and positions of the working chambers being changed in response to motion of the motional orbiter; a counter-pressure area defined between the wall of the housing and the motional orbiter; a guide device having an opening formed in the base plate of the motional orbiter and a pin fixedly coupled to and protruding from the housing, the pin engaging into the opening; and a sliding element disposed between the wall of the housing and the motional orbiter and fixedly coupled to the wall of the housing, wherein the sliding element is provided for compensation of friction generated by relative motion between the wall of the housing and the motional orbiter, wherein the pin is pressed into an opening formed in the sliding element, wherein the sliding element is pressed into and coupled to the housing by a force-fit, wherein the housing comprises a recess having a side and a base surface, the side of the recess is fitted and coupled to an outer jacket surface of the sliding element so that a first circular ring surface of the sliding element is fixed in contact with the base surface of the recess.

2. The apparatus according to claim 1, wherein the sliding element has a circular ring disk shape that has an inner diameter, an outer diameter, a thickness, the outer jacket surface, the first circular ring surface, and a second circular ring surface.

3. The apparatus according to claim 1, wherein the sliding element and the pin are made of materials in which values of strength and thermal expansion efficiency as material characteristics are similar.

4. The apparatus according to claim 1, wherein the sliding element is made of steel.

5. The apparatus according to claim 1, wherein the pin is made of steel.

6. The apparatus according to claim 1, wherein the sliding element comprises a ring-shaped groove for accommodation of a sealing element formed as an O-ring.

7. The apparatus according to claim 6, wherein the ring-shaped groove is formed on the outer jacket surface of the sliding element.

8. The apparatus according to claim 1, wherein the opening formed in the sliding element for accommodation of the pin is formed as a through-bore.

9. The apparatus according to claim 8, wherein the pin of the guide device is disposed in the through-bore wherein an end of the pin formed away from an end of the guide device engaging into the opening engages into an opening formed in the wall of the housing through the sliding element.

10. The apparatus according to claim 1, wherein the apparatus further comprises pin elements formed to dispose within openings formed in the sliding element and to protrude into openings formed in the wall of the housing.

* * * * *